US005798328A

United States Patent [19]

Kottwitz et al.

[11] Patent Number: 5,798,328

[45] Date of Patent: Aug. 25, 1998

[54] DETERGENT COMPOSITION COMPRISING CARBONATE-AMORPHOUS SILICATE COMPOUND AS BUILDER AND PROCESSES OF USING SAME

[75] Inventors: Beatrix Kottwitz; Joerg Poethkow, both of Duesseldorf; Horst Upadek, Ratingen, all of Germany

[73] Assignee: Henkel Kommanditgesellschaft auf Aktien, Duesseldorf, Germany

[21] Appl. No.: 702,568

[22] PCT Filed: Feb. 13, 1995

[86] PCT No.: PCT/EP95/00506

§ 371 Date: Aug. 22, 1996

§ 102(e) Date: Aug. 22, 1996

[87] PCT Pub. No.: WO95/22592

PCT Pub. Date: Aug. 24, 1995

[30] Foreign Application Priority Data

Feb. 22, 1994 [DE] Germany ..... 44 05 511.0

[51] Int. Cl.[6] ..... C11D 17/00; C11D 3/08; C11D 3/10; C11D 3/12

[52] U.S. Cl. ..... 510/438; 510/309; 510/315; 510/320; 510/323; 510/507; 510/509; 510/511; 510/531; 510/532

[58] Field of Search ..... 510/531, 532, 510/509, 510, 511, 512, 315, 349, 377, 438, 441, 442, 443, 444, 445, 451, 452, 309, 320, 323; 252/236, 232, 160

[56] References Cited

U.S. PATENT DOCUMENTS

| | | | |
|---|---|---|---|
| 3,821,119 | 6/1974 | Temple | 510/531 |
| 4,022,704 | 5/1977 | Balfanz et al. | 510/531 |
| 4,075,117 | 2/1978 | Morton et al. | 252/135 |
| 4,122,044 | 10/1978 | Nakamura et al. | 510/452 |
| 4,129,526 | 12/1978 | Ogoshi et al. | 510/443 |
| 4,427,417 | 1/1984 | Porasik | 23/313 R |
| 4,664,839 | 5/1987 | Rieck | 252/175 |
| 4,761,248 | 8/1988 | Clift | 510/444 |
| 4,816,553 | 3/1989 | Baur et al. | 528/245 |
| 4,992,079 | 2/1991 | Lutz et al. | 23/313 R |
| 5,300,250 | 4/1994 | Morgan et al. | 510/352 |
| 5,338,528 | 8/1994 | Sorensson et al. | 423/333 |
| 5,344,633 | 9/1994 | Sorensson et al. | 423/333 |
| 5,356,607 | 10/1994 | Just | 423/334 |
| 5,501,814 | 3/1996 | Engelskirchen et al. | 252/174.17 |
| 5,547,603 | 8/1996 | Sorrensson et al. | 510/509 |

FOREIGN PATENT DOCUMENTS

| | | |
|---|---|---|
| 0164514 | 12/1985 | European Pat. Off. . |
| 0267042 | 5/1988 | European Pat. Off. . |
| 0280223 | 8/1988 | European Pat. Off. . |
| 0486078 | 5/1992 | European Pat. Off. . |
| 0486079 | 5/1992 | European Pat. Off. . |
| 0488868 | 6/1992 | European Pat. Off. . |
| 0561656 | 9/1993 | European Pat. Off. . |
| 2722698 | 12/1977 | Germany . |
| 2730951 | 1/1978 | Germany . |
| 4221381 | 2/1994 | Germany . |
| 4300772 | 7/1994 | Germany . |
| 4330393 | 3/1995 | Germany . |
| 58-217598 | 12/1983 | Japan . |
| 1595770 | 8/1981 | United Kingdom . |
| WO 9013533 | 11/1990 | WIPO . |
| WO 9108171 | 6/1991 | WIPO . |
| WO 9308251 | 4/1993 | WIPO . |
| WO 9314182 | 7/1993 | WIPO . |
| WO 9316110 | 8/1993 | WIPO . |

OTHER PUBLICATIONS

English translation of EP 0 488 868, published Jun. 3, 1992, Feb. 1998.

English translation of EP 0 561 656, published Sep. 22, 1993, Feb. 1998.

English translation of WO 93/04154, published Mar. 4, 1993, Feb. 1998.

*Primary Examiner*—Ardith Hertzog

*Attorney, Agent, or Firm*—Ernest G. Szoke; Wayne C. Jaeschke; Real J. Grandmaison

[57] ABSTRACT

A detergent composition containing surfactants selected from anionic, cationic, nonionic, amphoteric and zwitterionic surfactants and a builder component containing 40% to 80% by weight of amorphous alkali metal silicates and 10% to 40% by weight of alkali metal carbonates in the form of a compound, with the proviso that the alkali metal carbonate content is always greater than the alkali metal silicate content, and at most 25% by weight of water, and wherein the compound does not have a homogeneous surface nor a uniform particle size distribution.

18 Claims, No Drawings

DETERGENT COMPOSITION COMPRISING CARBONATE-AMORPHOUS SILICATE COMPOUND AS BUILDER AND PROCESSES OF USING SAME

BACKGROUND OF THE INVENTION

1. Field of the Invention

This invention relates to a detergent which contains amorphous silicate-based builders and which shows both excellent primary and secondary washing properties.

2. Discussion of Related Art

It is known from the prior art that the performance of detergents can be enhanced by the use of carbonates and silicates. Thus, International patent application WO-A-93/14182 describes the subsequent addition of both carbonates and silicates to basic detergent granules. However, other applications disclose the production and use of carbonate/silicate compounds in detergents. These applications include, for example, European patent application EP-A-0 267 042 and British patent application GB-A-1,595,770, according to the teaching of which spray-dried carbonate/silicate compounds are used as carriers for nonionic surfactants in detergents.

Carbonate/silicate compounds which may be used as a substitute for conventional builders, such as zeolite, and for newer builders, such as crystalline layer-form sodium silicates, have also recently been described in the literature. They include the compounds according to European patent applications EP-A-0 486 078, EP-A-0 486 079, EP-A-0 488 868 or EP-A-0 561 656 which have been arbitrarily selected from the existing prior art and which have been cited purely by way of example.

However, it has now surprisingly been found that not only can carbonate/silicate compounds of the type in question be used as a replacement or partial replacement for zeolites and/or crystalline layer-form sodium silicates to inhibit incrustation, improvements in primary washing power and in the inhibition of redeposition can also be achieved by using carbonate/silicate compounds which do not have a uniform surface or a uniform particle size distribution.

DESCRIPTION OF THE INVENTION

Accordingly, the present invention relates to a detergent containing surfactants from the group of anionic, nonionic, cationic, amphoteric and zwitterionic surfactants, silicate-based builders and carbonates and, optionally, other ingredients of detergents, the detergent containing amorphous alkali metal silicates and alkali metal carbonates in the form of a compound which consists of about 40 to 80% by weight of alkali metal carbonate, about 10 to 40% by weight of alkali metal silicate, with the proviso that the alkali metal carbonate content is always greater than the alkali metal silicate content, and at most 25% by weight of water and which has neither a homogeneous surface nor a uniform particle size distribution.

In the context of the invention, "alkali metal carbonates" are also understood to include bicarbonates, although the use of dialkali metal carbonates is preferred. Sodium carbonate, potassium carbonate or mixtures thereof are particularly preferred, sodium carbonate generally being used.

The preferred amorphous alkali metal silicates include, above all, sodium silicates with a molar $Na_2O:SiO_2$ ratio of 1:1 to 1:3.5, molar ratios of 1:2 to 1:3 being particularly preferred. Compounds containing disilicates have proved to be particularly advantageous.

The compounds may be produced by any process which enables inhomogeneous surfaces and particle size distributions to be generated. For example, the compounds may be spray-dried and/or granulated and then partly size-reduced. Equally, mixtures of carbonates and silicates or even already spray-dried and/or granulated compounds may be roll-compacted or extruded, the strand issuing from the extrusion die being cut up, optionally after drying and/or cooling. The extrudates obtained are not subsequently spheronized in order not to destroy the inhomogeneity of the surface, which—macroscopically—is also distinguished by a certain roughness, or the particle size distribution. Preferred compounds consist partly of substantially spherical granules while other parts may be cylindrical and/or splinter-like with sharp edges and corners. The size of individual particles lies within a broad range. In a preferred embodiment, however, at most 20% by weight of the particles and, more particularly, at most 10% by weight of the particles have a smaller length diameter than 250 μm while at most 15% by weight of the particles and, more particularly, at most 10% by weight of the particles have a greater length diameter than 1.5 mm.

In another preferred embodiment of the invention, the carbonate/silicate compounds used in accordance with the invention have an apparent density of about 600 to 1100 g/l and, more particularly, in the range from 700 to 1000 g/l. The content of carbonates, preferably sodium carbonate, is advantageously between 45 and 75% by weight and, more particularly, between 50 and 70% by weight. At the same time, advantageous carbonate/silicate compounds have a silicate content, preferably a content of sodium silicate and, more particularly, sodium disilicate, of 15 to 40% by weight and, with particular advantage, 20 to 35% by weight, their water content not exceeding 22% by weight and, more particularly, 20% by weight. Particularly advantageous embodiments of the carbonate/silicate compounds have ratios by weight of carbonate to silicate, based on the sodium salts, of 2.2:1 to 1.8:1. A carbonate/silicate compound which satisfies all these requirements is, for example, Gransil®) which is commercially obtainable from the Colin Stewart company, Minchem (Great Britain).

The carbonate/silicate compounds mentioned may be used as a partial or full replacement for conventional builders. Accordingly, their content in the detergents according to the invention may be about 2 to 50% by weight but is preferably 5 to 40% by weight and, more preferably, 10 to about 35% by weight. In one preferred embodiment of the invention, the detergents are free from zeolite. However, if the detergents contain a combination of zeolite and the carbonate/silicate compounds mentioned, a preferred embodiment contains zeolite and carbonate/silicate compounds in a ratio by weight of 3:1 to 1:3 and, more particularly, 2:1 to 1:2. The content of carbonate/silicate compound in the detergents according to the invention preferably does not exceed 30% by weight. The zeolite used is preferably detergent-quality zeolite NaA. However, zeolite X or zeolite P, for example, and mixtures of zeolite A, X and P are also suitable. The zeolite may be used in the form of a spray-dried powder or even in the form of an undried, stabilized suspension still moist from its production. Where the zeolite is used in the form of a suspension, the suspension may contain small additions of nonionic surfactants as stabilizers, for example 1 to 3% by weight, based on zeolite, of ethoxylated $C_{12-18}$ fatty alcohols containing 2 to 5 ethylene oxide groups or ethoxylated isotridecanols. Suitable zeolites have an average particle size of less than 10 μm (volume distribution, as measured by the Coulter Counter method) and preferably contain 18 to 22% by weight and, more particularly, 20 to 22% by weight of bound water.

In another preferred embodiment of the invention, the detergent contains crystalline layer-form sodium silicates with the general formula $NaMSi_xO_{2x+1}.yH_2O$, where M is sodium or hydrogen, x is a number of 1.9 to 4 and y is a number of 0 to 20, preferred values for x being 2, 3 or 4, in combination with the carbonate/silicate compounds mentioned. Corresponding crystalline layer silicates are described, for example, in European patent application EP-A0 164 514. Preferred crystalline layer silicates corresponding to the above formula are those in which M stands for sodium and x assumes a value of 2 or 3. Both β- and δ-sodium disilicates $Na_2Si_2O_5.yH_2O$ are particularly preferred, β-sodium disilicate being obtainable, for example, by the process described in International patent application WO-A-91/08171. The combinations of crystalline layer-form sodium silicates and carbonate/silicate compounds may be used in a broad ratio by weight of around 10:1 to 1:10, ratios by weight of 3:1 to 1:3 being preferred and those of 2:1 to 1:2 being particularly preferred.

In another preferred embodiment of the invention, the detergents contain carbonate/silicate compounds in combination with crystalline layer-form sodium silicates corresponding to the general formula $NaMSi_xO_{2x+1}.yH_2O$, where M is sodium or hydrogen, x is a number of 1.9 to 4 and y is a number of 0 to 20, preferred values for x being 2, 3 or 4, and also zeolite. Particularly advantageous detergents have a content of carbonate/silicate compound of around 5 to 30% by weight, a content of crystalline layer-form sodium silicates of around 2 to 15% by weight and a zeolite content of also about 2 to 15% by weight, all these percentages by weight being based on the detergent as a whole. The ratios by weight between crystalline layer-form sodium silicates of the type mentioned and zeolite may vary over a range of 7.5:1 to 1:7.5, ratios by weight above 1:1 being particularly preferred.

Other ingredients of the detergents according to the invention include, above all, anionic, nonionic, cationic, amphoteric and/or zwitterionic surfactants. Preferred anionic surfactants of the sulfonate type are the known $C_{9-13}$ alkyl benzene sulfonates, α-olefin sulfonates and alkane sulfonates. Esters of α-sulfofatty acids and the disalts of α-sulfofatty acids are also suitable. Other suitable anionic surfactants are sulfonated fatty acid glycerol esters which represent mono-, di- and triesters and mixtures thereof which are obtained where production is carried out by esterification of a monoglycerol with 1 to 3 moles of fatty acid or in the transesterification of triglycerides with 0.3 to 2 moles of glycerol.

However, anionic surfactants of the sulfate type are particularly preferred. Preferred alk(en)yl sulfates are the alkali metal salts, preferably the sodium salts, of sulfuric acid semiesters of $C_{12-18}$ fatty alcohols, for example coco-fatty alcohol, tallow fatty alcohol, lauryl, myristyl, cetyl or stearyl alcohol, or $C_{10-20}$ oxoalcohols and those of secondary alcohols with the same chain length. Other preferred alk(en)yl sulfates are those with the chain length mentioned which contain a synthetic linear alkyl chain produced on a petrochemical basis which is similar in its degradation behavior to corresponding compounds based on oleochemical raw materials. $C_{16-18}$ alk(en)yl sulfates are of particular interest from the point of view of the washing process. It can also be of particular advantage, especially for machine detergents, to use the $C_{16-18}$ alk(en)yl sulfates in combination with low-melting anionic surfactants and, more particularly, with anionic surfactants which have a relatively low Krafft point and which show only a slight tendency towards crystallization at relatively low washing temperatures, for example from room temperature to 40° C. In one preferred embodiment of the invention, therefore, the detergents contain mixtures of short-chain and long-chain fatty alkyl sulfates, preferably mixtures of $C_{12-14}$ fatty alkyl sulfates or $C_{12-18}$ fatty alkyl sulfates with $C_{16-18}$ fatty alkyl sulfates and, more particularly, $C_{12-16}$ fatty alkyl sulfates with $C_{16-18}$ fatty alkyl sulfates. In another preferred embodiment of the invention, however, not only saturated alkyl sulfates, but also unsaturated alkenyl sulfates with an alkenyl chain length of preferably $C_{16}$ to $C_{22}$ are used. Mixtures of saturated sulfonated fatty alcohols consisting predominantly of $C_{16}$ and unsaturated sulfonated fatty alcohols consisting predominantly of $C_{18}$, for example those derived from solid or liquid fatty alcohol mixtures of the HD-Ocenol® type (a product of Henkel KGBA), are particularly preferred. Ratios by weight of alkyl sulfates to alkenyl sulfates of 10:1 to 1:2 and, more particularly, around 5:1 to 1:1 are preferred.

The sulfuric acid monoesters of straight-chain or branched $C_{7-21}$ alcohols ethoxylated with 1 to 6 moles of ethylene oxide, such as 2-methyl-branched $C_{9-11}$ alcohols containing on average 3.5 moles of ethylene oxide (EO) or $C_{12-18}$ fatty alcohols containing 2 to 4 EO, are also suitable. On account of their high foaming power, they are only used in relatively small quantities in detergents for machine washing.

Other suitable anionic surfactants are the salts of alkyl sulfosuccinic acid, which are also known as sulfosuccinates or sulfosuccinic acid esters, and the monoesters and/or diesters of sulfosuccinic acid with alcohols, preferably fatty alcohols and, more preferably, ethoxylated fatty alcohols. Alk(en)yl succinic acid preferably containing 8 to 18 carbon atoms in the alk(en)yl chain or salts thereof may also be used.

Other constituents include soaps, for example in quantities of 0.5 to 5% by weight. Suitable soaps are, for example, saturated fatty acid soaps, such as the salts of lauric acid, myristic acid, palmitic acid, stearic acid, hydrogenated erucic acid or behenic acid, and also soap mixtures derived in particular from natural fatty acids, for example coconut oil, palm kernel oil or tallow fatty acids. Soap mixtures of which 50 to 100% by weight consist of saturated $C_{12-24}$ fatty acid soaps are particularly preferred.

The anionic surfactants and soaps may be present in the form of their alkali metal salts, such as their sodium, potassium or ammonium salts, and as soluble salts of organic bases, such as mono-, di- or triethanolamine. The anionic surfactants and soaps are preferably present in the form of their sodium or potassium salts, more especially in the form of their sodium salts.

The content of anionic surfactants in the detergents according to the invention is preferably 5 to 35% by weight and more preferably 10 to 30% by weight, the use of fatty alk(en)yl sulfates and/or alkyl benzene sulfonate being preferred.

Preferred nonionic surfactants are alkoxylated, advantageously ethoxylated, more especially primary, alcohols preferably containing 8 to 18 carbon atoms and, on average, 1 to 12 moles of ethylene oxide (EO) per mole of alcohol, in which the alcohol radical may be linear or preferably 2-methyl-branched or may contain linear and methyl-branched radicals in the form of the mixtures typically present in oxoalcohol radicals. However, alcohol ethoxylates with linear radicals of alcohols of native origin containing 12 to 18 carbon atoms, for example of cocoalcohol, palm alcohol, tallow alcohol or oleyl alcohol, and an average of 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation shown are statistical mean values which, for a special product, may be a whole number or a broken number. Preferred alcohol ethoxylates have a narrow homolog distribution (narrow range ethoxylates, NRE). The detergents according to the invention contain 2 to 15% by weight of alkoxylated $C_{8-18}$ fatty alcohols and, more particularly, 5 to 10% by weight of ethoxylated $C_{12-18}$ fatty alcohols.

Another class of preferred nonionic surfactactants, which are used either as sole nonionic surfactant or in combination with other nonionic surfactants, more particularly together with alkoxylated fatty alcohols, are alkoxylated, preferably ethoxylated or ethoxylated and propoxylated fatty acid alkyl esters, preferably containing 1 to 4 carbon atoms in the alkyl chain, more particularly the fatty acid methyl esters which are described, for example, in Japanese patent application JP-A-58/217598 or which are preferably produced by the process described in International patent application WO-A-90113533.

In addition, alkyl glycosides corresponding to the general formula $RO(G)_x$, where R is a primary saturated or methyl-branched, more especially 2-methyl-branched, aliphatic radical containing 8 to 22 and preferably 12 to 18 carbon atoms and the G stands for a glycose unit containing 5 to 6 carbon atoms, preferably glucose, may also be used as further nonionic surfactants. The degree of oligomerization x, which indicates the distribution of monoglycosides and oligoglycosides, is a number of 1 to 10 and preferably a number of 1.2 to 1.4. The alkyl glycoside content of the detergents is generally about 0 to 5% by weight and preferably 0.5 to 3% by weight.

Nonionic surfactants of the amine oxide type, for example N-cocoalkyl-N,N-dimethylamine oxide and N-tallow alkyl-N,N-dihydroxyethylamine oxide, and the fatty acid alkanolamide type are also suitable. The quantity in which these nonionic surfactants are used is preferably no more than the quantity in which the ethoxylated fatty alcohols and the alkoxylated fatty acid alkyl esters are used and, more preferably, no more than half that quantity.

Other suitable surfactants are polyhydroxyfatty acid amides corresponding to formula (I):

$$R^2-CO-\overset{\overset{\displaystyle R^3}{|}}{N}-[Z] \qquad (I)$$

in which $R^2CO$ is an aliphatic acyl radical containing 6 to 22 carbon atoms, $R^3$ is hydrogen, an alkyl or hydroxyalkyl radical containing 1 to 4 carbon atoms and [Z] is a linear or branched polyhydroxyalkyl radical containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

Organic builders may also be used. Useful organic builders are, for example, the percarboxylic acids preferably used in the form of their salts, such as citric acid, adipic acid, succinic acid, glutaric acid, tartaric acid, sugar acids, aminocarboxylic acids, nitrilotriacetic acid (NTA), providing their use is ecologically safe, and mixtures thereof. Preferred salts are the sodium salts of polycarboxylic acids, such as citric acid, adipic acid, succinic acid, glutaric acid, tartaric acid, sugar acids and mixtures thereof. Their content in the detergents is generally from 0 to 15% by weight.

Suitable polymeric polycarboxylates are, for example, the sodium salts of polyacrylic acid or polymethacrylic acid, for example those with a relative molecular weight of 800 to 150,000 (based on acid). Suitable copolymeric polycarboxylates are, in particular, those of acrylic acid with methacrylic acid and those of acrylic acid or methacrylic acid with maleic acid. Copolymers of acrylic acid with maleic acid containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000. Other particularly preferred polymeric polycarboxylates are the terpolymers described in earlier German patent applications DE 42 21 381 and DE 43 00 772. The content of polymeric polycarboxylates, including the terpolymers, is preferably 2 to 7% by weight.

Other suitable builder systems are oxidation products of carboxyfunctional polyglucosans and/or water-soluble salts thereof which are described, for example, in International patent application WO-A-93/08251 or of which the production is described, for example, in International patent application WO-A-93/16110 or earlier German patent application P 43 30 393.0.

Other suitable builders are polyacetals which may be obtained by reaction of dialdehydes with polyol carboxylic acids containing 5 to 7 carbon atoms and at least three hydroxyl groups, for example as described in European patent application EP-A-0 280 223. Preferred polyacetals are obtained from dialdehydes, such as glyoxal, glutaraldehyde, terephthalaldehyde and mixtures thereof and from polyol carboxylic acids, such a gluconic acid and/or glucoheptonic acid.

The detergents according to the invention may contain further quantities of carbonates and bicarbonates in addition to the carbonate/silicate compounds used. This may even be preferred, depending on the formulation.

In addition to the ingredients mentioned, the detergents may contain other known additives typically used in detergents, for example bleaching agents and bleach activators, redeposition inhibitors, salts of polyphosphonic acids, enzymes, enzyme stabilizers, small quantities of neutral filler salts and optionally dyes and fragrances, opacifiers or pearlescers and optical brighteners.

Among the compounds yielding $H_2O_2$ in water which serve as bleaching agents, sodium perborate tetrahydrate and sodium perborate monohydrate are of particular importance. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid or diperdodecanedioic acid. The content of bleaching agents in the detergents is preferably from 5 to 25% by weight and more preferably from 10 to 20% by weight, perborate monohydrate and/or percarbonate advantageously being used.

Examples of suitable bleach activators are N-acyl or O-acyl compounds which form organic peracids with $H_2O_2$, preferably N,N'-tetraacylated diamines, p-(alkanoyloxy)-benzenesulfonates, also carboxylic anhydrides and esters of polyols, such as glucose pentaacetate. Particularly preferred bleach activators are N,N,N',N'-tetraacetyl ethylenediamine and 1,5-diacetyl-2,4-dioxohexahydro-1,3,5-triazine.

In addition, the detergents may also contain components with a positive effect on the removability of oil and fats from textiles by washing. This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and, in particular, methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates.

The function of redeposition inhibitors is to keep the soil detached from the fibers suspended in the wash liquor and thus to prevent discoloration. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose, methyl cellulose, hydroxyalkyl cellulose, and mixed ethers, such as methyl hydroxyethyl cellulose, methyl hydroxypropyl cellulose, methyl carboxymethyl cellulose, and mixtures thereof are preferably used. Carboxymethyl cellulose (Na salt), methyl cellulose, methylhydroxyethyl cellulose and mixtures thereof and also polyvinyl pyrrolidone are preferably used, for example in quantities of 0.1 to 5% by weight, based on the detergent.

The detergents may contain derivatives of diaminostilbene disulfonic acid or alkali metal salts thereof as optical brighteners. Suitable optical brighteners are, for example, salts, of 4,4'-bis-(2-anilino4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)4'-(2-sulfostyryl)-diphenyl, may also be present. Mixtures of the brighteners mentioned above may also be used.

Suitable enzymes are those from the class of proteases, lipases, amylases, cellulases and mixtures thereof. Enzymes obtained from bacterial strains or fungi, such as *Bacillus subtilis, Bacillus licheniformis, Streptomyces griseus* and *Humicola insolens,* are particularly suitable. Proteases of the subtilisin type are preferably used, proteases obtained from *Bacillus lentus* being particularly suitable. Enzyme mixtures, for example mixtures of protease and amylase or protease and lipase or protease and cellulase or mixtures of cellulase and lipase or mixtures of protease, amylase and lipase or protease, lipase and cellulase, but especially cellulase-containing and protease-containing mixtures, are of particular interest. (Per)oxidases have also proved to be suitable. The enzymes may be adsorbed to supports and/or encapsulated in shell-forming substances to protect them against premature decomposition. It is also possible to use proteases which have been stabilized with soluble calcium salts and which have a calcium content of, preferably, around 1.2% by weight, based on the enzyme. It has surprisingly been found that, in particular, the effect of the enzymes can be significantly improved by the use of the compounds mentioned as opposed to conventional builders, such as zeolite or crystalline layer-form sodium silicates.

The neutrally reacting sodium salts of, for example, 1-hydroxyethane-1,1-diphosphonate and diethylenetriamine pentamethylenephosphonate are preferably used as the salts of polyphosphonic acids in quantities of 0.1 to 1.5% by weight.

Where the detergents are used in machine washing processes, it can be of advantage to add typical foam inhibitors to them. Suitable foam inhibitors are, for example, soaps of natural or synthetic origin with a high percentage content of $C_{18-24}$ fatty acids. Suitable non-surface-active foam inhibitors are, for example, organopolysiloxanes and mixtures thereof with microfine, optionally silanized silica and also paraffins, waxes, microcrystalline waxes and mixtures thereof with silanized silica or bis-stearyl ethylenediamide. Mixtures of various foam inhibitors, for example mixtures of silicones, paraffins or waxes, are also used with advantage. The foam inhibitors, more particularly silicone- or paraffin-containing foam inhibitors, are preferably fixed to a granular water-soluble or water-dispersible support. Mixtures of paraffins and bis-stearyl ethylenediamides are particularly preferred.

The apparent density of the advantageously granular detergents is preferably at least about 600 g/l and, more particularly, in the range from 650 to 1100 g/l. However, detergents with a lower apparent density may also be produced.

The detergents may be produced by any of the known processes, such as mixing, spray drying, granulation and extrusion. Particularly suitable processes are those in which several components, for example spray-dried components and granulated and/or extruded components, are mixed with one another. Spray-dried or granulated components may even be subsequently impregnated during processing, for example with nonionic surfactants, more particularly ethoxylated fatty alcohols, by standard methods. In granulation and extrusion processes in particular, the anionic surfactants present, if any, are preferably used in the form of a spray-dried, granulated or extruded compound either as an added component in the process or as an additive subsequently incorporated in other granules. It is also possible and, depending on the formulation, can also be of advantage for other individual components of the detergent, for example carbonates, citrate or citric acid or other polycarboxylates or polycarboxylic acids, polymeric polycarboxylates, zeolite and/or layer silicates, for example layer-form crystalline disilicates, to be subsequently incorporated in spray-dried, granulated and/or extruded components which are optionally impregnated with nonionic surfactants and/or other ingredients liquid to wax-like at the processing temperature. A preferred process is one in which the surface of individual components of the detergent or the detergent as a whole is subsequently treated to reduce the tackiness of the granules rich in nonionic surfactants. Suitable surface modifiers are known from the prior art. In addition to other suitable modifiers, fine-particle zeolites, silicas, amorphous silicates, fatty acids or fatty acid salts, for example calcium stearate, but especially mixtures of zeolite and silicas or zeolite and calcium stearate, being particularly preferred.

Accordingly, a particularly preferred process is characterized in that a basic detergent of standard composition is produced by known methods and a carbonate/silicate compound which consists of about 40 to 80% by weight of alkali metal carbonate, about 10 to 40% by weight of alkali metal silicate, with the proviso that the alkali metal carbonate content is always greater than the alkali metal silicate content, and at most 25% by weight of water and which has neither a homogeneous surface nor a uniform particle size distribution is subsequently added, the detergent optionally being further processed after addition of the carbonate/silicate compound, preferably with fine-particle powder-form and/or liquid to paste-like detergent ingredients.

EXAMPLES

Granular detergents with the compositions shown below (Table 1) were produced. The detergents differed in their water contents as a result of the different raw materials used. The exchange was made via sodium sulfate. The detergent D1 according to the invention contained a carbonate/silicate compound known as Gransil® (a product of Colin Stewart, Minchem, Great Britain) which contained 54% by weight of sodium carbonate, 27% by weight of amorphous sodium disilicate and 19% by weight of water. The apparent density of this compound was above 800 g/l. In Comparison Example C1, the compound was replaced by the same quantity of zeolite NaA, based on water-free active substance and, in Comparison Example C2, by the same quantity of crystalline layer-form β-sodium disilicate which had been produced in accordance with the teaching of International patent application WO-A-91/08171.

TABLE 1

Composition of Detergents D1, C1 and C2 (In % by Weight)

| | D1 | C1 | C2 |
|---|---|---|---|
| $C_{16-18}$ Alkyl sulfate | 8 | 8 | 8 |
| $C_{12-18}$ Fatty acid soap | 1 | 1 | 1 |
| $C_{12-18}$ Fatty alcohol · 5 EO | 5.5 | 5.5 | 5.5 |
| Gransil ® | 27 | — | — |
| Zeolite NaA (waterfree active substance) | — | 27 | — |
| β-Disilicate | — | — | 27 |
| Sodium carbonate | 8 | 8 | 8 |
| Amorphous sodium silicate (1:3.0) | 1.5 | 1.5 | 1.5 |
| Perborate tetrahydrate | 20 | 20 | 20 |
| Tetraacetyl ethylenediamine | 5.5 | 5.5 | 5.5 |
| Acrylic acid copolymer | 5 | 5 | 5 |
| CMC/MC | 0.1 | 0.1 | 0.1 |
| Phosphonate | 0.5 | 0.5 | 0.5 |
| Protease granules | 1 | 1 | 1 |
| Foam inhibitor based on silicone oil | 0.7 | 0.7 | 0.7 |
| Sodium sulfate and water | Rest | Rest | Rest |

Performance testing was carried out under simulated practical conditions in domestic washing machines. To this end, the machines were loaded with 3.0 kg of clean ballast washing and 0.5 kg of test fabrics, the test fabrics having been impregnated with typical test soils for testing primary washing power and consisting of white fabrics for testing the inhibition of redeposition. Strips of standardized cotton fabric (Wäschereiforschungsanstalt Krefeld, WFK), grey cotton cloth (GCC), knitted fabric (cotton tricot; T) and terry cloth (TC) were used as the white test fabrics.

Washing conditions for primary washing power

Tap water with a hardness of 23° d (equivalent to 230 mg CaO/l), quantity of detergent used per detergent and machine 98 g, washing temperatures 60° C. and 90° C., liquor ratio (kg of washing: liter of wash liquor in the main wash cycle) 1:5.7, 3× rinsing with tap water, spinning and drying.

| Soils: |
|---|
| dust/wool fat on cotton (DW-C) |
| dust/sebum on cotton (DS-C) |
| dust/sebum on crease-resistant cotton (DS-CCr) |
| dust/sebum on a blend of polyester and crease-resistant cotton (DS-PCCr) |
| milk/soot on cotton (MS-C) |
| milk-cocoa on cotton (MC-C) |
| red wine on cotton (R-C) |
| tea on cotton (T-C) |

Washing conditions for redeposition inhibition

Tap water with a hardness of 23° d (equivalent to 230 mg CaO/l), quantity of detergent used per detergent and machine 98 g, washing temperature 90° C., liquor ratio (kg of washing: liter of wash liquor in the main wash cycle) 1:5.7, 3× rinsing with tap water, spinning and drying, number of washes: 25. Surprisingly, virtually the starting whiteness values of the test fabrics used were achieved after 25 washes with the detergent D1 according to the invention.

TABLE 2

Primary Washing Power (Reflectance in %) at 90° C.

| | D1 | C1 | C2 |
|---|---|---|---|
| DW-C | 79.0 | 76.8 | 77.7 |
| DS-C | 74.2 | 72.2 | 74.8 |
| DS-CCr | 78.4 | 77.5 | 77.2 |
| DS-PCCr | 70.0 | 64.3 | 64.6 |
| MS-C | 81.4 | 74.9 | 79.7 |
| MC-C | 84.8 | 79.3 | 83.9 |
| R-C | 81.9 | 80.6 | 79.8 |
| T-C | 80.8 | 78.8 | 79.1 |

TABLE 3

Primary Washing Power (Reflectance in %) at 60° C.

| | D1 | C1 | C2 |
|---|---|---|---|
| DS-CCr | 69.1 | 68.7 | 67.1 |
| DS-PCCr | 58.7 | 58.8 | 54.3 |
| MS-C | 79.5 | 70.4 | 77.0 |
| MC-C | 79.9 | 73.1 | 77.9 |

TABLE 4

Inhibition of Redeposition (Reflectance in %)

| | WFK | GCC | T | TC |
|---|---|---|---|---|
| Initial value | 84.7 | 86.8 | 87.2 | 87.2 |
| D1 | 82.1 | 86.0 | 86.0 | 86.7 |
| C1 | 79.3 | 84.1 | 82.1 | 82.4 |
| C2 | 76.9 | 82.1 | 80.7 | 82.3 |

What is claimed is:

1. A detergent composition containing surfactants selected from the group consisting of anionic, nonionic, cationic, amphoteric and zwitterionic surfactants, said composition further containing a builder component comprising amorphous alkali metal silicates and alkali metal carbonates in the form of a compound which consists of at most 25% by weight of water, about 40% to 80% by weight of alkali metal carbonate and about 10% to 40% by weight of alkali metal silicate, with the proviso that the alkali metal carbonate content is always greater than the alkali metal silicate content of said compound, and wherein said compound has a particle size distribution wherein at most 20% by weight of the particles have a smaller length diameter than 250 μm, and at most 15% by weight of the particles have a larger length diameter than 1.5 mm.

2. A detergent composition as in claim 1 wherein the carbonate/silicate compound has a content of carbonate of 45% to 75% by weight and a silicate content of 15% to 40% by weight, the water content not exceeding 22% by weight.

3. A detergent composition as in claim 1 containing about 2% to 50% by weight of the carbonate/silicate compound.

4. A detergent composition as in claim 1 containing zeolite and the carbonate/silicate compound in a ratio by weight of 3:1 to 1:3 wherein the content of carbonate/silicate compound in the detergent composition does not exceed 30% by weight.

5. A detergent composition as in claim 1 which is zeolite-free.

6. A detergent composition as in claim 1 further containing crystalline layer-form sodium silicates having the general formula $NaMSi_xO_{2x+1}.yH_2O$ where M is sodium or hydrogen, x is a number of 1.9 to 4 and y is a number of 0 to 20.

7. A detergent composition as in claim 6 further containing zeolite wherein the content of carbonate/silicate compound is 5% to 30% by weight, the content of crystalline layer-form sodium silicates is 2% to 15% by weight, and the content of zeolite is 2% to 15% by weight, all weights based on the weight of said detergent composition.

8. A detergent composition as in claim 1 further containing an enzyme selected from the group consisting of proteases, lipases, amylases, cellulases and mixtures thereof.

9. A detergent composition as in claim 1 further containing a peroxy bleaching agent.

10. The process of washing a soiled surface comprising contacting said surface with a detergent composition containing surfactants selected from the group consisting of anionic, nonionic, cationic, amphoteric and zwitterionic surfactants, said composition further containing a builder component comprising amorphous alkali metal silicates and alkali metal carbonates in the form of a compound which consists of at most 25% by weight of water, about 40% to 80% by weight of alkali metal carbonate and about 10% to 40% by weight of alkali metal silicate, with the proviso that the alkali metal carbonate content is always greater than the alkali metal silicate content of said compound and wherein said compound has a particle size distribution wherein at most 20% by weight of the particles have smaller length diameter than 250 μm, and at most 15% by weight of the particles have a larger length diameter than 1.5 mm.

11. A process as in claim 10 wherein the carbonate/silicate compound has a content of carbonate of 45% to 75% by weight and a silicate content of 15% to 40% by weight, the water content not exceeding 22% by weight.

12. A process as in claim 10 wherein said detergent composition contains about 2% to 50% by weight of the carbonate/silicate compound.

13. A process as in claim 10 wherein said detergent composition contains zeolite and the carbonate/silicate compound in a ratio by weight of 3:1 to 1:3 wherein the content of carbonate/silicate compound in the detergent composition does not exceed 30% by weight.

14. A process as in claim 10 wherein said detergent composition is zeolite-free.

15. A process as in claim 10 wherein said detergent composition further contains crystalline layer-form sodium silicates having the general formula $NaMSi_xO_{2x+1}.yH_2O$, where M is sodium or hydrogen, x is a number of 1.9 to 4 and y is a number of 0 to 20.

16. A process as in claim 15 wherein said detergent composition further contains zeolite wherein the content of the carbonate/silicate compound is 5% to 30% by weight, the content of crystalline layer-form sodium silicates is 2% to 15% by weight, and the content of zeolite is 2% to 15% by weight, based on the weight of said detergent composition.

17. A process as in claim 10 wherein said detergent composition contains enzymes selected from the group consisting of proteases, lipases, amylases, cellulases and mixtures thereof.

18. A process as in claim 10 wherein said detergent composition contains a peroxy bleaching agent.

* * * * *